US009745701B2

(12) United States Patent
Kronzer et al.

(10) Patent No.: US 9,745,701 B2
(45) Date of Patent: Aug. 29, 2017

(54) CASTING PAPERS AND THEIR METHODS OF FORMATION AND USE

(75) Inventors: Frank J. Kronzer, Woodstock, GA (US); Stephen C. Lapin, Waterford, WI (US); Steven E. Rosenberg, Roswell, GA (US); John A. Pugliano, Herriman, UT (US)

(73) Assignee: Neenah Paper, Inc., Alpharetta, GA (US)

( * ) Notice: Subject to any disclaimer, the term of this patent is extended or adjusted under 35 U.S.C. 154(b) by 1487 days.

(21) Appl. No.: 13/213,160

(22) Filed: Aug. 19, 2011

(65) Prior Publication Data

US 2013/0045330 A1 Feb. 21, 2013

(51) Int. Cl.

| | |
|---|---|
| ***B41M 3/12*** | (2006.01) |
| ***D21H 27/00*** | (2006.01) |
| *D21H 19/16* | (2006.01) |

(52) U.S. Cl.

CPC ..... *D21H 27/001* (2013.01); *D21H 19/16* (2013.01)

(58) Field of Classification Search

CPC .... D06P 5/003; D21H 27/001; B29C 37/0025
USPC ..... 427/146, 147, 148, 153, 551, 552, 554
See application file for complete search history.

(56) References Cited

U.S. PATENT DOCUMENTS

| | | | | |
|---|---|---|---|---|
| 4,327,121 | A | 4/1982 | Gray, III | |
| 4,515,849 | A * | 5/1985 | Keino et al. | 428/201 |
| 4,548,857 | A * | 10/1985 | Galante | 428/200 |
| 4,959,264 | A | 9/1990 | Dunk et al. | |
| 5,164,475 | A | 11/1992 | Wheland | |
| 5,166,186 | A * | 11/1992 | Kojime et al. | 522/37 |
| 5,492,599 | A | 2/1996 | Olson | |
| 5,707,472 | A * | 1/1998 | Smith | 156/240 |
| 5,951,507 | A | 9/1999 | Hilston et al. | |
| 5,981,011 | A | 11/1999 | Overcash | |
| 6,150,024 | A * | 11/2000 | Dhoot et al. | 428/421 |
| 6,509,077 | B1 | 1/2003 | Wantuch | |

(Continued)

FOREIGN PATENT DOCUMENTS

| | | |
|---|---|---|
| EP | 0106695 A1 | 4/1984 |
| WO | WO 00/64685 A1 | 11/2000 |

(Continued)

OTHER PUBLICATIONS

International Search Report for Appl. No. PCT/US2012/049252.

*Primary Examiner* — Michael Wieczorek
(74) *Attorney, Agent, or Firm* — Dority & Manning, P.A.

(57) ABSTRACT

Methods are generally disclosed for forming and using a casting paper. In one embodiment, the casting paper can be made by coating a first surface of a base sheet with a release coating such that the release coating covers the entire first surface of the base sheet. A printed release coating is then applied on a portion of the first release coating, and is dried or cured as needed to form the casting paper having a textured surface defined by elevated areas corresponding to the printed release coating and valley areas corresponding to exposed areas of the printed release coating. In another embodiment, the casting paper can be made by first printing a base sheet with a patterned, structured coating, then coating over the patterned, structured coating with a release coating such that the release coating covers at least the unprinted areas of the base sheet. The casting paper can be used to form a texturized surface in a substrate.

18 Claims, 4 Drawing Sheets

(56) References Cited

U.S. PATENT DOCUMENTS

| | | | | |
|---|---|---|---|---|
| 6,869,910 | B2 * | 3/2005 | Williams et al. | 503/227 |
| 6,875,553 | B2 | 4/2005 | Daniel et al. | |
| 6,902,779 | B1 * | 6/2005 | de Visser et al. | 428/32.12 |
| 7,238,410 | B2 * | 7/2007 | Kronzer | 428/195.1 |
| 2002/0081420 | A1 | 6/2002 | Kronzer | |
| 2009/0116126 | A1 | 5/2009 | Berzon et al. | |

FOREIGN PATENT DOCUMENTS

| | | | |
|---|---|---|---|
| WO | WO 2005/052082 | A1 | 6/2005 |
| WO | WO 2009/059299 | A1 | 5/2009 |

* cited by examiner

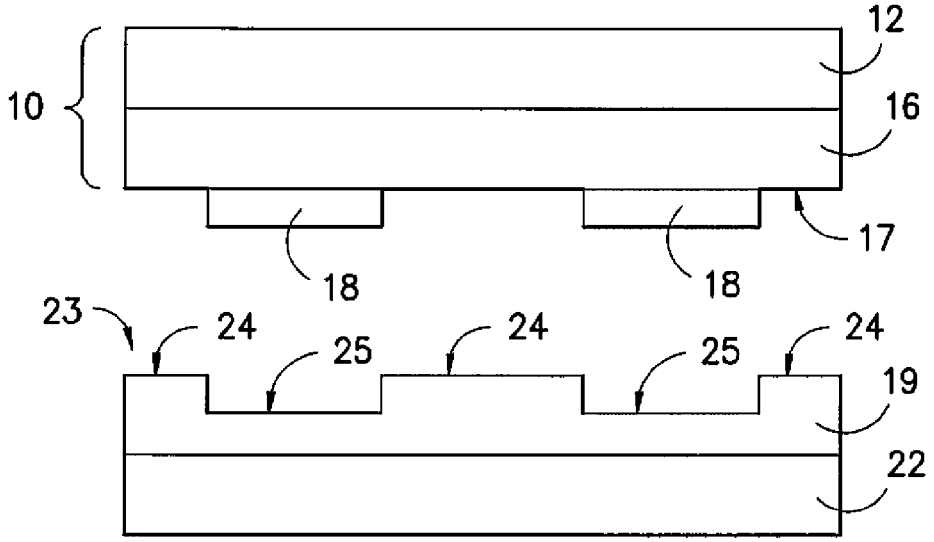
FIG. –5–
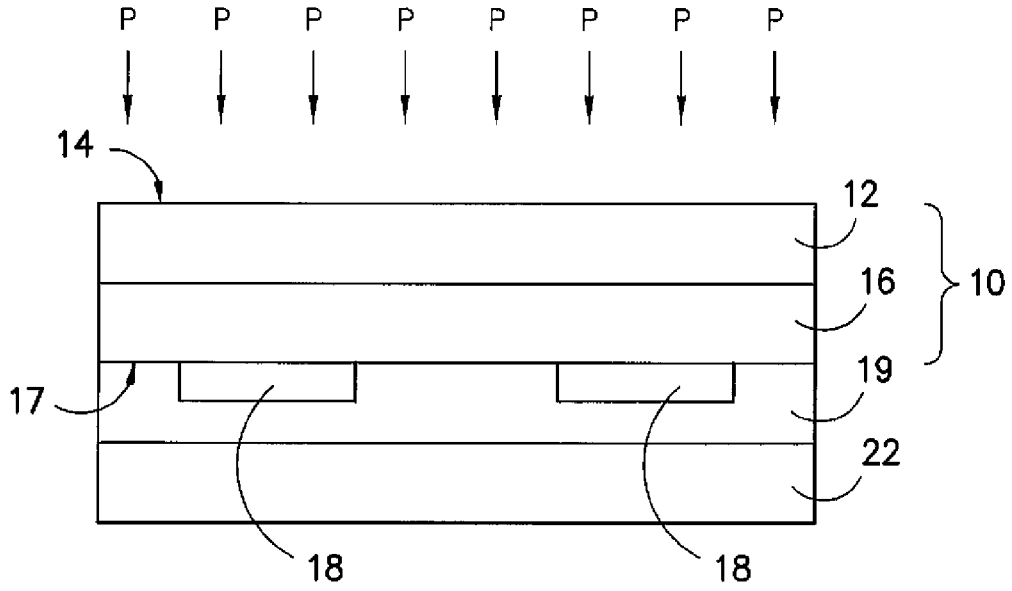
FIG. –6–

CASTING PAPERS AND THEIR METHODS OF FORMATION AND USE

BACKGROUND OF THE INVENTION

Casting paper or molding paper is used in the casting or molding of plastics to impart a textured surface. For example, PVC coated cloth can be embossed through the use of casting paper to form imitation leather. Casting paper can also be used for casting blocks of polyurethane as required principally in the furniture and automotive industries. Casting paper generally has a release surface, smooth or carrying a negative or reverse of a pattern (emboss) required in the final substrate (e.g., artificial leather). For example, when forming artificial leather, the casting paper can be used by extruding thermoplastic polyurethane or a polyvinylchloride plastisol onto the release surface; this is then dried or cured on the casting paper. The polyurethane or polyvinylchloride plastisol can then be transferred to a cloth surface to form the artificial leather. The artificial leather, carrying the positive impression of the original embossing roll, can then be stripped from the surface of the casting paper.

As such, casting paper needs to meet very severe requirements of heat resistance, clean stripping and repeated use, while retaining its embossed surface. One of the materials preferred in the art for use in forming the release surface is polymethylpentene (e.g., TPX from Mitsui Chemicals), which shows especially good heat resistance compared to other thermoplastic polymers. Polymethylpentene has been in use since the mid 1970's, but it is very expensive. Also, it can distort under high pressure or when heated at temperatures above about 350 degrees F. Highly crosslinked coatings are generally used if better heat resistance is needed.

In a typical process of forming casting paper, a release coating is coated onto the paper and texturized utilizing an embossed drum. The hard embossing roll has protrusions or knobs disposed in a desired pattern thereon to press into the surface of the coating. When the thermoplastic polymer polymethylpentene is the release coating, the coated paper is embossed against a heated drum and then simply cooled. The highly crosslinked release coatings are formed by first applying a curable liquid, which can contain a polymer or polymer precursor. The polymer or polymer precursor coating can contain water or solvent which is evaporated prior to curing or it can be 100% non-volatile. The paper with the curable coating is then pressed against an embossing drum and cured before the paper removed, giving a patterned coating which is heat resistant. However, these embossing drums are very expensive to produce. Therefore, the production of casting paper with a given pattern is not economical unless a particular drum is used to produce large volumes of casting paper with that particular pattern. Thus, changing the pattern formed in the release surface of the casting paper in this manner is expensive, effectively prohibiting the development of readily customized casting papers.

As such, a need exists for an affordable, more flexible method for forming casting papers, which will then make a wider variety of customized casting papers readily available.

SUMMARY OF THE INVENTION

Aspects and advantages of the invention will be set forth in part in the following description, or may be obvious from the description, or may be learned through practice of the invention.

Methods are generally disclosed for forming and using a casting paper. In one embodiment, the casting paper can be made by coating a first surface of a base sheet with a release coating such that the release coating covers the entire first surface of the base sheet and then curing the release coating if needed. A printed release coating is then applied (e.g., flexographically printed, offset printed, rotary screen printed, etc.) on a portion of the cured release coating, and is dried and cured as needed to form the casting paper having a textured surface defined by elevated areas corresponding to the printed release coating and valley areas corresponding to exposed areas of the first release coating. Generally, both the release coating and the print coating comprise, independently, a polymeric coating with heat resistance. In one particular embodiment, the curable polymeric material includes a curable monomer (e.g., trimethylolpropane triacrylate), a curable polymer (e.g., an acrylic polymer), and a release agent (e.g., a curable silicone polymer).

In another embodiment, a patterned surface is formed on a first surface of a substrate by printing using known printing techniques such as flexography, offset printing, rotary screen printing, etc.); then a release coating is applied to the resulting patterned surface so that the release coating covers at least the unprinted areas of the printed substrate. It also conforms to the patterned surface and thus has only a minimal effect on its structure. In this embodiment, the printed structure can be formed from a variety of materials, provided that the materials can be applied in a printing process, are rigid enough after drying or curing to withstand the pressure used in the intended casting process and are heat resistant enough to maintain the needed rigidity at the temperatures used in the casting process. In one particular embodiment, the printed structure can be formed from a curable composition (e.g. a mixture of a curable resin and monomers). The release coating can be adapted for release of the material which one wants to cast or form in the intended use of the invention. Examples of applicable release coatings include silicone coatings which are curable with heat, ultraviolet light or electron beams.

The casting paper can be used to form a texturized surface in a substrate. For instance, a thermoplastic layer can be coated onto the textured surface of the casting paper. Then, the thermoplastic layer can be positioned adjacent to a substrate, followed by heat transfer of the thermoplastic layer to the substrate. The casting paper can then be removed from the substrate. Alternatively, a thermoplastic surface on a substrate can be heated and the textured surface of the casting paper can then be pressed into the thermoplastic surface. The casting paper can then be removed from the thermoplastic surface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof to one skilled in the art, is set forth more particularly in the remainder of the specification, which includes reference to the accompanying figures, in which:

FIGS. 4-5 sequentially show an exemplary heat transfer for transferring the thermoplastic layer of FIG. 3 to a substrate;

FIG. 6 shows another exemplary step of forming a texturized surface in a thermoplastic layer of a substrate;

Figure 1:
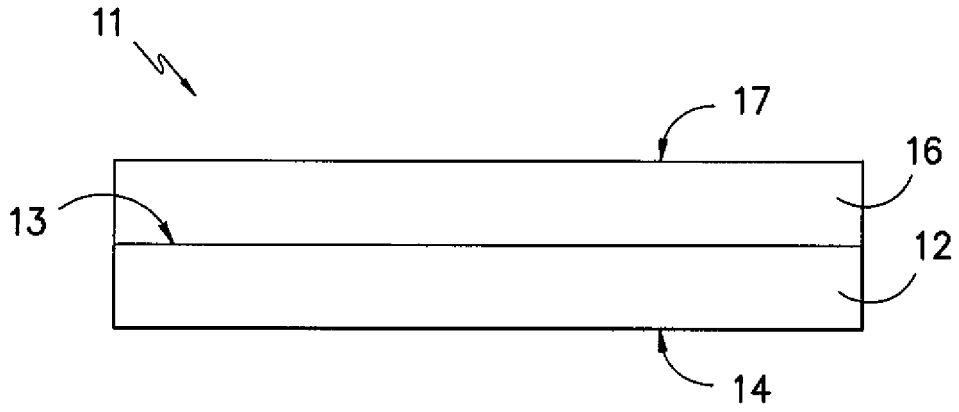
FIG. 1 shows a release paper including a base sheet with an exposed release coating according to one exemplary embodiment of the present invention.

Repeat use of reference characters in the present specification and drawings is intended to represent the same or analogous features or elements of the present invention.

Definitions

The term "molecular weight" generally refers to a weight-average molecular weight unless another meaning is clear from the context or the term does not refer to a polymer. It long has been understood and accepted that the unit for molecular weight is the atomic mass unit, sometimes referred to as the "dalton." Consequently, units rarely are given in current literature. In keeping with that practice, therefore, no units are expressed herein for molecular weights.

As used herein, the term "cellulosic nonwoven web" is meant to include any web or sheet-like material which contains at least about 50 percent by weight of cellulosic fibers. In addition to cellulosic fibers, the web may contain other natural fibers, synthetic fibers, or mixtures thereof. Cellulosic nonwoven webs may be prepared by air laying or wet laying relatively short fibers to form a web or sheet. Thus, the term includes nonwoven webs prepared from a papermaking furnish. Such furnish may include only cellulose fibers or a mixture of cellulose fibers with other natural fibers and/or synthetic fibers. The furnish also may contain additives and other materials, such as fillers, e.g., clay and titanium dioxide, surfactants, antifoaming agents, and the like, as is well known in the papermaking art.

As used herein, the term "polymer" generally includes, but is not limited to, homopolymers; copolymers, such as, for example, block, graft, random and alternating copolymers; and terpolymers; and blends and modifications thereof. Furthermore, unless otherwise specifically limited, the term "polymer" shall include all possible geometrical configurations of the material. These configurations include, but are not limited to isotactic, syndiotactic, and random symmetries.

The term "thermoplastic polymer" is used herein to mean any polymer which softens and flows when heated; such a polymer may be heated and softened a number of times without suffering any basic alteration in characteristics, provided heating is below the decomposition temperature of the polymer. Examples of thermoplastic polymers include, by way of illustration only, polyolefins, polyesters, polyamides, polyurethanes, acrylic ester polymers and copolymers, polyvinyl chloride, polyvinyl acetate, etc. and copolymers thereof.

In the present disclosure, when a layer is being described as "on" or "over" another layer or substrate, it is to be understood that the layers can either be directly contacting each other or have another layer or feature between the layers (unless otherwise stated). Thus, for example as shown in the figures and described in the accompanying descriptions, these terms are simply describing the relative position of the layers to each other and do not necessarily mean "on top of" since the relative position above or below depends upon the orientation of the structure to the viewer.

In this discussion, the term "release coating" indicates a coating which has release properties for a number of materials and is durable. A material which "has release properties for a second material" means here that the second material can be removed from the first, release material, easily and without damage to either the release material or the second material.

The term "substrate" refers to a material to which coatings can be applied and, as such, encompasses a wide variety of materials.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

Generally speaking, methods of forming a casting paper are provided, along with the resulting casting papers and their use in forming a texturized surface on a substrate. The presently disclosed methods generally allow for customized images to be formed in the casting paper, which in turn allows for customized images to be formed in the texturized surface of the substrate. For example, a user can print any desired image onto the casting paper, in the form of a printed coating, to form a customized casting paper.

I. Release Coated Sheet with a Second Printed Release Coating

According to one embodiment, the casting paper can be made by printing a patterned release coating onto a release substrate. As shown in FIG. 1, the release substrate 11 generally includes a base sheet 12 that acts as a backing or support layer. The base sheet 12 is flexible and has a first surface 13 and a second surface 14. For example, the base sheet 12 can be a film or a cellulosic nonwoven web. In addition to flexibility, the base sheet 12 also provides strength for handling, coating, sheeting, other operations associated with the manufacture thereof, and for removal after embossing. The basis weight of the base sheet 12 generally may vary, such as from about 30 to about 150 $g/m^2$. Suitable base sheets 12 include, but are not limited to, cellulosic nonwoven webs and polymeric films. A number of suitable base sheets 12 are disclosed in U.S. Pat. Nos. 5,242,739; 5,501,902; and U.S. Pat. No. 5,798,179; the entirety of which are incorporated herein by reference.

Desirably, the base sheet 12 comprises paper. A number of different types of paper are suitable for the present invention including, but not limited to, litho label paper, bond paper, and latex saturated papers. In some embodiments, the base sheet 12 can be a latex-impregnated paper such as described, for example, in U.S. Pat. No. 5,798,179. The base sheet 12 is readily prepared by methods that are well known to those skilled in the art of paper making. The smoothness of the base sheet used in casting release materials can be critical, especially if the casting material is to be used to impart a smooth or glossy surface. As a general rule, it is easy to understand that the surface of the base sheet should be about as smooth as or smoother than the smoothness desired in the final coated substrate. Surface smoothness can be measured by various methods. One method is the Sheffield method. In this method, a circular rubber plate or gasket with a hole in the center is applied with a specified pressure to the substrate. Air is forced under a specified pressure into the center hole and the air flow resulting from air escaping from under the gasket is measured. The higher the air flow, measured in milliliters per minute, the rougher the substrate. For many casting applications, papers such as clay coated papers with Sheffield smoothness less than about 100 are smooth enough, while very fine castings may require smoother substrates such as films with Sheffield smoothness of around 10 or less.

The release coating 16 is coated over the entire first surface 13 of the base sheet 12 such that substantially all of the first surface 13 is covered by the release coating 16. For example, the release coating 16 is shown in FIG. 1 applied directly onto the first surface 13 of the base sheet 12 with a substantially flat, smooth, release surface 17. The release coating 16 is applied to the base sheet 12 to form the release paper 11 by known coating techniques, such as by roll, blade, Meyer rod, air-knife coating procedures, extrusion coating etc.

The release coating 16, after curing if needed, generally does not melt or become tacky when heated, and provides release of the thermoplastic substrate during a hot or cold peel process. A number of release coatings 16 are known to those of ordinary skill in the art, any of which may be used in the present invention. This includes high melting thermoplastics such as polymethylpentene and highly cross-linked coatings. For example, the release coating 16 can include a cured polymeric material and a release agent. The cured polymeric material can be, in one embodiment, formed by curing a curable monomer, a curable polymer, and a cross-linking agent together. The curable monomer is selected to react with the curable polymer to form a highly crosslinked release coating. In one particular embodiment, the curable monomer includes trimethylolpropane triacrylate (TMPTA), which is a trifunctional monomer with a relatively low volatility and fast cure response. Due to the trifunctionality of this monomer, the resulting cured polymeric material is highly crosslinked, resulting in high heat resistance and a durable release coating 16.

The curable polymer may include, but is not limited to, silicone-containing polymers, polyester acrylates, epoxy acrylates and acrylated polyurethanes. Further, other materials having a low surface energy, such as polysiloxanes and fluorocarbon polymers, may be used in the release coating layer. Another desirable release coating 16 comprises cured polyurethane containing an organosilicone. The compounded coating is a water based dispersion, which is dried and cured after application. Organosilicones are silicone polymers with organic groups other than methyl groups and many have organic side chains. For example, block copolymers of dimethyl siloxane and ethylene oxide. Suitable organosilicones include Silwet J1015-O, an additive often used as a surfactant which contains a dimethyl siloxane chain and ethylene oxide and propylene oxide side chains. Suitable polyurethane dispersions include, but are not limited to, LUX 481, a UV or electron beam curable polyurethane dispersion available from Alberdingk Boley, Greensboro, N.C. and Ucecoat 7578, available from Cytec Industries Inc., West Paterson, N.J.

The release coating 16 may be cured thermally, with ultraviolet light or with an electron beam. Thermal curing is commonly practiced in the art and generally takes place via reaction of a crosslinker with the polymer chains in the coating. Examples include reaction of epoxide crosslinkers with hydroxyl groups on the polymer chain, reaction of multifunctional aziridines with carboxyl groups on the polymer chain and reaction of free radicals with unsaturated groups on the polymer chain. The free radicals are generated thermally from compounds which cleave into free radical fragments when heated (such as peroxides).

The release coating 16 may further contain additives including, but not limited to, surfactants, defoamers viscosity-modifying agents, solvents, dispersants and water. Suitable surfactants for water based coatings include, but are not limited to, TERGITOL® 15-S40, available from Union Carbide; TRITON® X100, available from Union Carbide; and Silicone Surfactant 190, available from Dow Corning Corporation and a host of others. In addition to acting as a surfactant, Silicone Surfactant 190 also functions as a release modifier, providing improved release characteristics.

As stated, the release coating 16 can be cured after application to the first surface 13 of the base sheet 12. Curing generally transforms the curable polymeric material into a highly crosslinked layer configured to withstand multiple heating and pressing cycles encountered during repeated use of the finished casting paper.

In one embodiment, the release coating 16 can be cured via a non-thermal curing process. For example, the release coating 16 can be exposed to an e-beam curing process or an UV curing process. Electron beam (e-beam) curing is a non-thermal curing process that generally involves exposing the curable material to a stream of electrons (e.g., using a linear accelerator). The electrons then react with materials in the coating to produce free radicals, which crosslink the coating by reacting with unsaturated sites on the polymer chains, and with unsaturated groups in the crosslinkers or monomers in the coating. UV curing is a non-thermal curing process that generally involves exposing the curable material to electromagnetic radiation having a wavelength in the ultra-violet range (e.g., about 10 nm to about 400 nm). Generally, a photoinitiator is needed for UV curing. Photoinitiators are materials which react with UV radiation to form free radicals, which then crosslink the coating as described above by reacting with unsaturated groups in the coating. The curing process can be configured to produce the desired degree of crosslinking in the release coating 16 by altering the amount of energy supplied to the cured layer (e.g., by adjusting the time the release coating 16 is exposed to the curing process).

The release coating 16 may have a layer thickness, selected as desired to ensure coverage of the substrate. Typically, the release coating 16 has a thickness of less than about 50 microns (μm). More desirably, the release coating 16 has a thickness of about 1 μm to about 35 μm. Even more desirably, the release coating 16 has a thickness of from about 3 μm to about 10 μm.

The amount of release coating 16 applied may also be described in terms of a coating weight, which is easier to measure than the thickness. When the coating weight is described in terms of grams per square meter, the coating thickness, expressed in microns, is obtained by dividing the coating weight in grams per square meter by the density. Desirably, the release coating 16 has a dry coating weight of less than about 50 grams per square meter (gsm). More desirably, the release coating 16 has a dry coating weight of from about 1 gsm to about 35 gsm. Even more desirably, the release coating 16 has a dry coating weight of from about 3 gsm to about 10 gsm.

Figure 2:
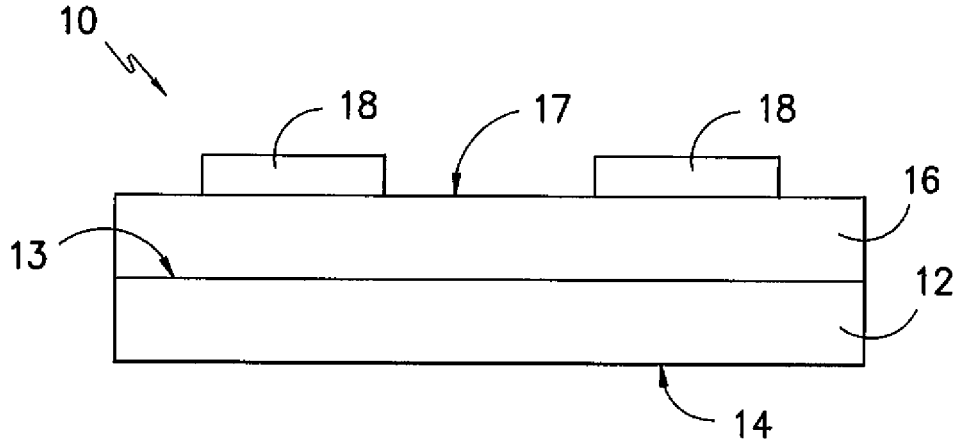
FIG. 2 shows a printed release coating applied over the release paper of FIG. 1 to form a casting sheet according to one exemplary embodiment of the present invention.

After application of the release coating 16 on the release paper 11 and drying or curing if desired, a printed release coating 18 can be applied (and dried or cured if desired) on the release coating 16 to form a casting paper 10, as shown in FIG. 2. The printed release coating 18 is applied in the shape of the mirror image of the design to be formed on the substrate 22. One of ordinary skill in the art would be able to produce and print such a mirror image, using any one of many commercially available software picture/design programs. In addition, the printed image is the inverse of the image desired on the substrate 22. That is, if the surface of the substrate is called the XY plane and the dimension extending out from the XY plane of the substrate is called the Z direction, and if the casting paper has an XY plane on its surface and a Z direction extending outward; a three dimensional plot of the casting paper will be the inverse, in the Z direction, of the three dimensional plot desired in the substrate 22.

Referring to FIG. 2, an exemplary casting paper 10 is shown having the print coating 18 applied to the release coating 16. In FIG. 2, an image is positively defined in the printed area of the release coating 16, with the remainder of the release surface 17 of the release coating 16 being free of the print coating 18, to form the casting surface of the casting paper 10. As stated, the image defined by print coating 18 is a mirror image and an inverse image of the desired coated image to be applied to the final substrate.

In a particular embodiment, the printed release coating 18 can be printed onto the printable transfer sheet via flexographic printing. Of course, any other printing method can be utilized to print an image onto the printable sheet provided that it is able to deposit enough material to produce the desired pattern. Preferred printing methods for coarse textures are therefore those capable of depositing thick printed layers, such as screen printing and rotary screen printing.

The printed release coating 18 can have compositions and properties similar to the release coating 16. Specifically, the printed release coating 18 generally does not melt or become tacky when heated. For example, the composition of the printed release coating 18 can include the materials discussed above with respect to the release coating 16, independent of the composition of the release coating 16. However, in one particular embodiment, the printed release coating 18 may include the same components as the release coating 16 (e.g., the composition of the release coating 16 and the printed release coating 18 may be substantially identical).

After applying the printed release coating 18 (e.g., via flexographic printing) to the release surface 17, the print coating 18 can be cured. As with the curing process of the release coating 16, curing generally transforms the curable polymeric material into a highly crosslinked layer configured to withstand multiple heating and pressing cycles encountered during repeated use of the final casting paper. Generally, the curing processes described above for the first release coating are applicable.

In one embodiment, the printed release coating 18 and the release coating 16 can be cured at the same time, that is, the release coating 16 is cured only after application of the printed release coating 18 and the heat or radiation cures both coatings at the same time. In another embodiment, the release coating 16 is partially cured before application of the printed release coating and the curing of the release coating 16 and the printed release coating 18 is completed in a second curing step. Partial curing of the first release coating can result in a surface which is solid and strong enough for subsequent printing of the printed release coating 18, but which has a higher surface energy than the fully cured release coating. The higher surface energy enables better wetting of the surface with the printed release coating and better bonding of the printed release coating. The printed release coating 18 can be cured thermally or via an e-beam curing process or an UV curing process. Electron beam (e-beam) curing is a non-thermal curing process that generally involves exposing the curable material to a stream of electrons (e.g., using a linear accelerator). UV curing is a non-thermal curing process that generally involves exposing the curable material to electromagnetic radiation in the having a wavelength in the ultra-violet range (e.g., about 10 nm to about 400 nm). The curing process can be configured to produce the desired degree of crosslinking in the print coating 18 by altering the amount of energy supplied to the cured layer (e.g., by adjusting the time the print coating 18 is exposed to the curing process).

If desired, the casting paper 10 may be dried before curing, by means of, for example, steam-heated drums, air impingement, radiant heating, or some combination thereof.

The printed release coating 18 may have a layer thickness selected as desired to control the amount of texturing to be formed in the substrate and thus may vary considerably. In fact, since the coating is textured its thickness may vary from zero to a considerable thickness in even a small area. Thus, it is more useful to describe the printed release coating 18 coating in terms of its maximum thickness. The maximum thickness of the printed release coating 18 can range from near zero to about 100 microns.

Multiple applications of printed release coating 18 may be carried out if one wishes to create very thick or very complex structures, for example, if one wants to incorporate fine features and coarse features into a design. When this is done, the same printed release coating 18 can be applied more than once or these additional applications may be done with altered coatings as needed. For example, one may need lower viscosity coatings to produce fine features and higher viscosity ones for producing coarse features, or, one may want to add pigments to some of the coatings to help visualize the printed structures. Registration, or correct alignment, of the printed coatings will usually be required if multiple layers are applied. Registration methods for printing are readily available and are familiar to those skilled in the art of printing.

Figure 3:
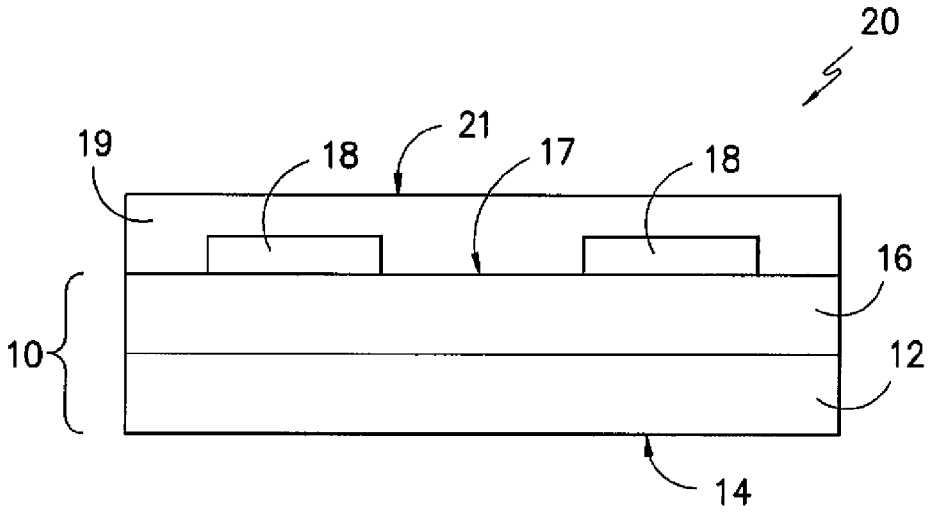
FIG. 3 shows a thermoplastic layer applied over the casting paper of FIG. 2.
Figure 4:
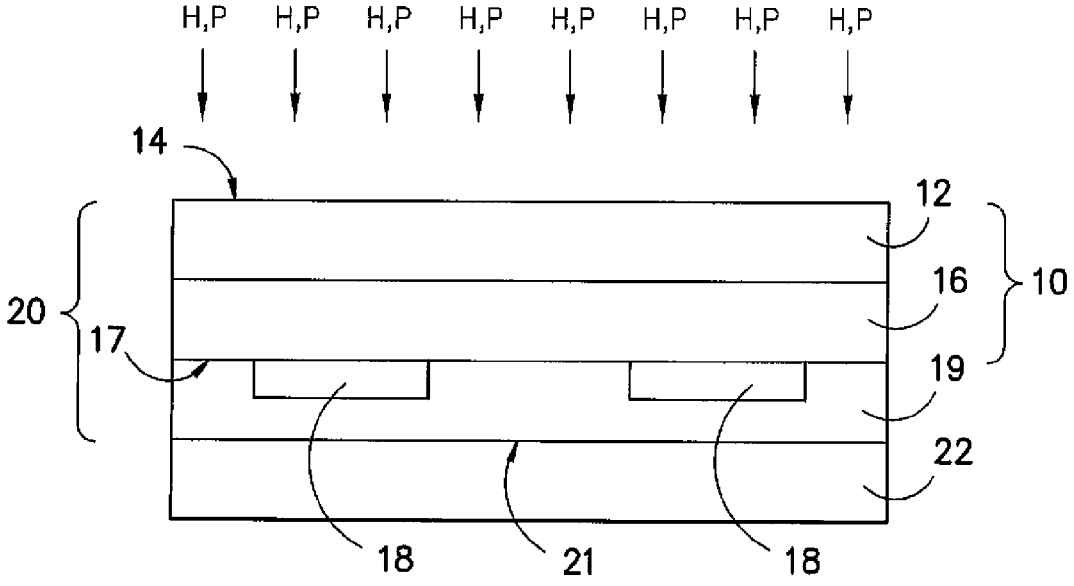

One particular method of using the casting paper 10 is as a heat transfer paper to form a texturized surface in a substrate is shown sequentially in FIGS. 3-5. According to this method, a thermoplastic layer 19 is applied onto the casting paper 10 over the print coating 18 and the exposed release surface 17 of the release coating 16 to form a heat transfer paper 20 shown in FIG. 3.

Generally, the thermoplastic layer 19 can include any thermoplastic material suitable for heat transfer. This includes thermoplastic polyurethanes, plasticized polyvinyl chloride and acrylic polymers.

After formation, the thermoplastic layer 19 forms a thermoplastic surface 21 on the heat transfer paper 20. The thermoplastic layer 19 can then be transferred to a substrate 22 by positioning the thermoplastic surface 21 adjacent to the substrate 22. Applying heat (H) and pressure (P) to the second surface 14 of the base sheet 12 causes the thermoplastic layer 19 to melt and attach to the substrate 22. Attachment of the thermoplastic layer 19 at its thermoplastic surface 21 to the substrate 22 is particularly good when the substrate 22 is porous (e.g., a web of fibers, either nonwoven or woven). Temperatures used in this process can range from about 200 degrees F. to about 400 degrees F.

Upon cooling, the thermoplastic layer 19 generally conforms to the shape of the casting paper 10, specifically the texture formed by the printed coating 18 and the exposed release surface 17 of the release coating 16. The casting paper 10 can then be removed from the transferred thermoplastic layer 19 (due to the release properties of the print coating 18 and the exposed release surface 17 of the release coating 16), leaving a texturized surface 23 defined by peaks 24 and valleys 25 on the substrate 22. Generally, the peaks 24 correspond to the exposed release surface 17 of the release coating 16 on the casting paper 10, while the valleys 25 correspond to the printed coating 18 of the casting paper 10.

An alternative method of using the casting paper 10 to form a texturized surface in a substrate is shown in FIG. 6. According to this method, the casting paper 10 shown in FIG. 2 is pressed (using pressure (P)) into a thermoplastic layer 19 already on the substrate 22 and heated (i.e., softened) such that the thermoplastic layer 19 conforms to the surface texture of the casting paper 10. Upon cooling, the casting paper 10 can then be removed to form the texturized surface 23 as shown in FIG. 5.

The casting paper 10 can be used to apply thermoplastics to any substrate 22 (e.g., a porous substrate) using the methods of the present disclosure. An example is application of structured thermoplastic polyurethanes to cloth to form artificial leather. Texturizing surfaces of PETG panels by heat pressing them against casting papers constitutes another use of the casting paper 10. PETG is a glycol modified polyethylene terephthalate thermoplastic which is transparent and has a low softening point compared to PET (polyethylene terephthalate).

II. Casting Paper with a Printed, Patterned Coating and a Release Coating

Figure 7:
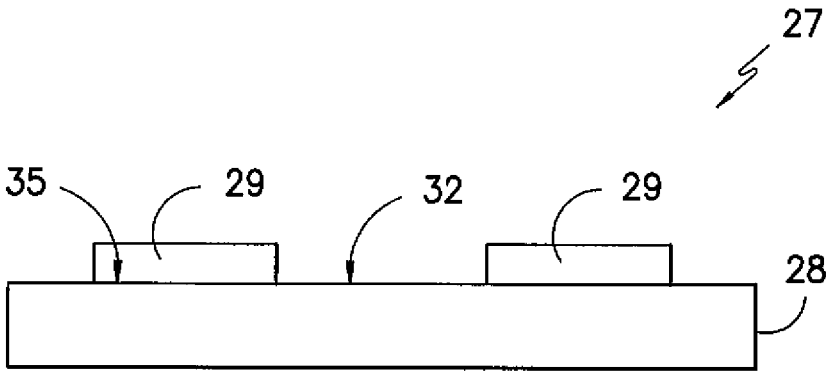
FIG. 7 shows a forming paper with a patterned, printed coating on the surface.
Figure 8:
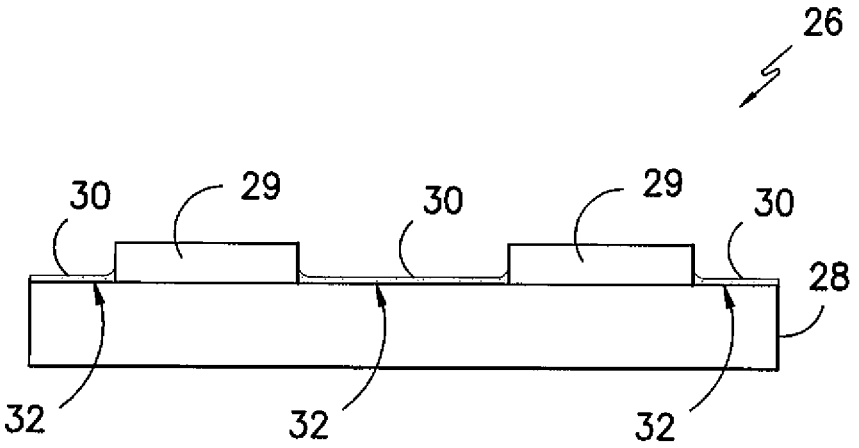
FIG. 8 shows a release coating applied to the patterned, printed coating of the forming paper.

Another embodiment of a casting sheet very similar to the above embodiment is casting sheet 26 shown in FIG. 8. As shown in FIG. 7, a patterned forming sheet 27 is produced by printing a base sheet 28 with a patterned coating 29. Then, as shown in FIG. 8, a release coating 30 is applied over the base sheet 28, so that the release coating 30 conforms to the surface and covers at least the exposed areas 32 of the patterned forming sheet 26 not covered by the patterned coating 29.

As shown in FIG. 7, the casting paper 26 generally includes a base sheet 28 that acts as a backing or support layer, as explained above with respect to FIGS. 1-6. For example, the base sheet 28 can be a film or a cellulosic nonwoven web. In addition to flexibility, the base sheet 28 also provides strength for handling, coating, sheeting, other operations associated with the manufacture thereof, and for removal after embossing. The basis weight of the base sheet 28 generally may vary, such as from about 30 to about 150 $g/m^2$. Suitable base sheets 28 include, but are not limited to, cellulosic nonwoven webs and polymeric films. A number of suitable base sheets 28 are disclosed in U.S. Pat. Nos. 5,242,739; 5,501,902; and U.S. Pat. No. 5,798,179; the entirety of which are incorporated herein by reference.

Desirably, the base sheet 28 comprises paper. A number of different types of paper are suitable for the present invention including, but not limited to, litho label paper, bond paper, and latex saturated papers. In some embodiments, the base sheet 28 can be a latex-impregnated paper such as described, for example, in U.S. Pat. No. 5,798,179. The base sheet 28 is readily prepared by methods that are well known to those skilled in the art of paper making. The smoothness of the base sheet used in casting release materials can be critical, especially if the casting material is to be used to impart a smooth or glossy surface. As a general rule, it is easy to understand that the surface of the base sheet should be about as smooth as or smoother than the smoothness desired in the final coated substrate. Surface smoothness can be measured by various methods. One method is the Sheffield method. In this method, a circular rubber plate or gasket with a hole in the center is applied with a specified pressure to the substrate. Air is forced under a specified pressure into the center hole and the air flow resulting from air escaping from under the gasket is measured. The higher the air flow, measured in milliliters per minute, the rougher the substrate. For many casting applications, papers such as clay coated papers with Sheffield smoothness less than about 100 are smooth enough, while very fine castings may require smoother substrates such as films with Sheffield smoothness of around 10 or less.

The patterned coating 29 is applied to a first surface 35 of the base sheet 28. The patterned coating 29 is printed in the shape of the mirror image of a design to be produced in a casting process, such as depicted in FIGS. 4, 5 and 6. One of ordinary skill in the art would be able to produce and print such a mirror image, using any one of many commercially available software picture/design programs. In addition, the printed image is the inverse of the image one wishes to create in the casting process. That is, if the surface of a substrate is called the XY plane and the dimension extending out from the XY plane of the substrate is called the Z direction, and if the casting paper has an XY plane on its surface and a Z direction extending outward; a three dimensional plot of the casting paper will be the inverse, in the Z direction, of the three dimensional plot desired in the substrate.

The printed, patterned coating 29 is applied to a first surface 35 of base sheet 28. In a particular embodiment, the patterned coating is printed via flexographic printing. Of course, any other printing method may be used, provided that it is able to deposit enough material to produce the desired pattern. Preferred printing methods for coarse textures are therefore those capable of depositing thick printed layers, such as screen printing and rotary screen printing.

The printed, patterned coating generally does not melt or become tacky when heated and thus retains its shape when subjected to heat and pressure in a casting process. Coating materials which can be dried or cured to form rigid, heat resistant masses are well known and can constitute hard, infusible particles and a binder. Examples of hard, infusible particles include ceramic micro beads and glass micro beads, available, for example, from Cospheric Santa Barbara, Calif.; Also, crosslinked polymer particles such as caliber CA6, 6 micron size crosslinked polymethylmethacrylate beads from Microbeads Norway, Skedsmokorset, Norway. The binder can be a water based polymeric dispersion or a latex, a solvent borne polymer or a 100% active curable composition. Any binder is suitable provided that, after drying or curing as needed for the particular binder, it becomes rigid and heat resistant so that the printed, patterned coating retains its shape when subjected to heat and pressure in a casting process. Binders which become highly crosslinked are preferred because crosslinking improves the rigidity and heat resistance of the binder. The patterned, printed coating may be cured thermally, with ultraviolet light or with an electron beam. Thermal curing is commonly practiced in the art and generally takes place via reaction of a crosslinker with the polymer chains in the coating. Examples include reaction of epoxide crosslinkers with hydroxyl groups on the polymer chain, reaction of multifunctional aziridines with carboxyl groups on the polymer chain and reaction of free radicals with unsaturated groups on the polymer chain. The free radicals are generated thermally from compounds which cleave into free radical fragments when heated (such as peroxides).

The patterned, printed coating 29 may further include materials which improve processing of the coating including, but not limited to, surfactants, defoamers viscosity-modifying agents, solvents, dispersants and water. Suitable surfactants for water based coatings include, but are not limited to, TERGITOL® 15-S40, available from Union Carbide; TRITON® X100, available from Union Carbide; and Silicone Surfactant 190, available from Dow Corning Corporation and a host of others. In addition to acting as a surfactant, Silicone Surfactant 190 also functions as a release modifier, providing improved release characteristics. Suitable viscosity modifiers for water soluble coatings are well known to those skilled in the art, and include water soluble polymers such as methyl cellulose and salts of poly-acrylic acid. Viscosity modifiers for solvent based coatings and 100% active coatings include compatible resins and polymers soluble in the particular solvent or carrier being used. For example, acrylated urethanes and acrylated epoxy resins.

The printed, patterned coating 29 may have a layer thickness selected as desired to control the amount of texturing to be formed in the substrate and thus may vary considerably. In fact, since the coating is textured its thickness may vary from zero to a considerable thickness in even a small area. Thus, it is more useful to describe the printed, patterned coating 29 in terms of its maximum thickness. The maximum thickness of the patterned, printed coating 29 can range from near zero to about 100 microns.

Multiple applications of patterned, printed coating 29 may be carried out if one wishes to create very thick or very complex structures, for example, if one wants to incorporate fine features and coarse features into a design. When this is done, the same printed, patterned coating 29 can be applied more than once or these additional applications may be done with altered coatings as needed. For example, one may need lower viscosity coatings to produce fine features and higher viscosity ones for producing coarse features, or, one may want to add pigments to some of the coatings to help visualize the printed structures. Registration, or correct alignment, of the printed coatings will usually be required if multiple layers are applied. Registration methods for printing are readily available and are familiar to those skilled in the art of printing.

The printed, patterned coating 29 may be formulated so it provides release of the thermoplastic substrate during a hot or cold peel process. Thus, the printed, patterned coating 29 may include a cured polymeric material and a release agent, as described above with respect to the printed release coating 18. The cured polymeric material can be, in another embodiment, formed by application and curing of a mixture of a curable monomer, a curable polymer, and a cross-linking agent. If the release properties of the printed, patterned coating are sufficient, the release coating 30 (discussed below) may cover only the unprinted areas 32 of the printed forming sheet 27.

A release coating 30 is applied to the printed forming sheet 27 to form the casting paper 26 shown in FIG. 8. The release coating conforms to the patterned surface and covers at least the exposed portions 32 of the printed forming sheet 27. The release coating does not appreciably alter the pattern in the patterned, printed coating 29, and is thin compared to the thickness of the features of the patterned, printed coating 29. Therefore, release coatings which are very efficient, that is, which are effective when applied in very thin layers, are preferred. Examples of very efficient release coatings are the Syl-Off silicone release coatings available from Dow Corning, Midland, Mich. These release coatings are available in solvents or as water based emulsions and are curable with heat. Suitable efficient release coatings can also comprise curable water based coatings with release additives. For example, Michem Prime 4983 with Xama 7, added for crosslinking with heat, and Siltech J-1015 O, added as a release agent. Michem Prime 4983 is a water based dispersion of an ethylene-acrylic acid copolymer. XAMA 7 is a polyfunctional aziridine crosslinker. Siltech J-1015 O is a surfactant having a polydimethylsiloxane chain and both ethylene oxide and propylene oxide side chains. Useful water based release coatings which can be cured with an electron beam or with UV radiation can be formulated by adding a release agent such as Silwet J-1015 O to a curable polyurethane dispersion such as LUX 481, available from Alberdingk Boley, Greensboro, N.C. For UV curing, a photoinitiator is needed.

If the patterned, printed coating 29 has release properties needed in the casting application, the release coating 30 may cover only the unprinted areas 32 of the forming sheet 27, as shown in FIG. 8. However, in another embodiment, the release coating 32 may cover both the printed coating 29 and the unprinted areas 32.

The casting paper 26 may be used in exactly the same manner as the casting paper 10; these uses are depicted in FIGS. 3 to 5.

EXAMPLES

Example 1

Printing Plate Preparation and Release Coated Paper with a Second Layer Printed Release Coating A sample of Neenah paper 9791P0 was embossed for 30 seconds at 375 degrees F. in a heat press with a sample of a "sand" pattern commercial casting paper available from SAPPI, Boston, Mass. This released easily after heat pressing to give the embossed 9791P0 paper. Note: Neenah Paper 9791P0 has a base paper of 24 lb. Classic Crest, a 25 micron thick layer of low density polyethylene and a release coating which is approximately 10 microns thick; the release coating is crosslinked but accepts water based coatings, inks, etc. The paper embosses easily with heat and pressure because the polyethylene layer melts and flows. A mixture of Monolite Blue BXE HD paste, Hycar 26706 acrylic latex and Acrysol RM 8 associative thickener made into a viscous ink and applied with a blade to the embossed 9791P0 paper gave small samples with a visually enhanced image. The small samples, approximately 2 inches by 4 inches, were large enough to enable preparation of printing plates.

Printing plates for a flexographic press were made by Para Print, Inc., Ivyland, Pa. The plates were 17 inches wide and 24 inches wide. The plates were used in printed release coating pilot runs done at PCT, Davenport, Iowa and described below.

First Release Coating. Sample 1.

Coating "L", used as a first release coating, consisted of 40% Ebecryl 3700-20T, an epoxy acrylate; 40% Trimetholyl propane triacrylate and 20% SR 335, which is lauryl acrylate. The paper was called 100 Pound Sterling Ultra gloss Web Text, which is a two side 'clay coated' publication grade. The paper was coated at PCT on a pilot line equipped for flexographic printing.

Initial coating tests with release coating "L" were done using a 27 bcm anilox roll and a smooth rubber applicator roll with a speed ratio of one to one at a line speed of 50 feet per minute. Note: the bcm number of the anilox roll is a measure of the volume it can deliver, measured in billion cubic microns per inch. Also, it should be noted that the volume of coating will be reduced if the anilox roll is run slower than the transfer roll; the transfer roll being the roll which transfers the coating to the substrate.)

The cure was done in a nitrogen flooded atmosphere with less than 200 ppm oxygen. The current voltage was 150 kilovolts with the current at 20 miliamps, which gives a dosage of 4 megarads at a line speed of 50 feet per minute. The printed width was 17 inches. This gave a glossy, dry coating which had good release for tape and a Sharpie marker. The coating weight was 8 grams per square meter. The coating had a slight pattern thought to be from the anilox roll. Changing the roll speeds to run the anilox roll at 25% of the applicator roll speed gave a smoother coating with only a trace of streaks. The coating weight was 6 grams per square meter. A release coated sample, Sample 1, was then produced at 50 feet per minute with this anilox/applicator condition, 150 kilovolts and 4 megarads (20 miliamp current).

Sample 1 was tested for release with a black chisel point Sharpie marker, a blue ballpoint pen and a Uni Paint oil based marker and these could be wiped off with a dry towel.

Sample 1 released easily from PETG panels after pressing for 5 minutes at 275 degrees F. in a heat press. The release of water based polymers Rhoplex B 20 (The Dow Chemical Company, Midland, Mich.), Sancure 2710 (Lubrizol Advanced Materials, Inc., Wickliffe, Ohio), Witcobond W296 (Brenntag Specialties, Inc, South Plainfield, N.J.), Permax 230 (Lubrizol Advanced Materials, Inc., Wickliffe, Ohio), and Vycar 578 (Lubrizol Advanced Materials, Inc., Wickliffe, Ohio) were tested by applying these to sample one, then heat pressing the coated samples against a piece of cotton t shirt material for 25 seconds at 375 degrees F. They all released easily. Rhoplex B 20 showed signs of poor spreading; this was corrected by adding 0.5 dry parts per 100 parts dry B 20, of Q2-5211, a wetting agent, to the Rhoplex B 20.

First Release Coating. Sample 2.

This sample was identical to first release coating, Sample 1, except that the curing dosage was reduced to 1 megarad. This gave a dry coating which wet better than the first release coating, Sample 1 in printing tests below.

Printing trials were first carried out on the 100 lb. Sterling paper (above) without the first release coating on it to provide data to establish conditions for good print resolution. The printed release coating was the same as used above, called coating "L". A 17 inch wide plate with the patterned image from Paraprint, described above, was used. The anilox roll was the same 27 bcm roll as used for the first release coat. The speed ratio of the applicator and anilox rolls was one to one. The line was run at 50 feet per minute and the coating was cured with 150 kilovolt radiation at 4 megarads (20 miliamps) in a Nitrogen atmosphere with less than 100 ppm Oxygen. The paper showed a defined pattern of cured coating, but resolution was poor. The resolution became increasingly better as the line speed was increased to 100 fpm (4 megarads, 40 miliamps), 200 fpm (4 megarads, 80 miliamps) and 400 fpm (4 megarads, 160 miliamps).

Printing trials on paper with no first release coating were then done using a 10 born anilox roll to improve resolution. A small amount of blue pigment (1% of the coating "L") was added to help visualize the printed pattern. The same speed trials as in the first printing attempt above were done and, again, the resolution was seen to improve as the speed was increased, becoming 'very good' at 400 fpm. The results in the speed trials in Examples 3 and 4 are thought to be due to spreading of the coating. After the initial application, the coating spreads out until it is cured, so the resolution is better at faster speeds.

Release Coated Paper with a Second, Printed Release Coating, Sample 3.

Paper from Sample 2, above (having only the I megarad cure) was printed using a 10 born anilox roll, the Paraprint printing plate and the blue tinted coating "L" at 50 feet per minute (4 megarads, 20 miliamps) and at 400 fpm (4 megarads, 160 miliamps). Again, the higher speed gave better printing, but for a different reason; in this experiment, the print coating tended to "de-wet" so that the printed areas tended to shrink. The de-wetting was also very time dependent and thus the higher speed gave very good print fidelity.

Sample 3 was used to emboss a PETG plate; a sheet of the paper was placed on both sides of a PETG plate with the coated sides against the plate. The sandwich was then pressed in a heat press for 5 minutes at 275 degrees F. After removal from the press, the paper could be removed while still warm but was difficult to remove after cooling completely. The PETG panel was embossed, as desired.

Sancure 2710, a water based polyurethane emulsion, was coated onto a sheet of Sample 3. After drying the emulsion at 80 degrees F., it could be easily removed from the paper as a film. However, it could not be removed after pressing the polyurethane coated paper to a fabric at 350 degrees F. for 30 seconds. The reason for the poorer release of Sample 3 compared to Sample 1 is thought to be the reduced cure of the first release coating. Even though the first coating of Sample 3 received the 4 megarads on the second pass, this apparently did not give the same result as curing it with 4 megarads in the first pass.

Handsheet Samples.

The 100 lb. Sterling Paper was coated with (first) release coatings at 7 grams per square meter. These release coatings were water based and were applied with a Meyer rod, then dried in a forced air oven. The following first release coatings were tried: Sample "A" coating was 100 dry parts of Lux 399 and 10 dry parts of Siltech J-1015-O. Lux 399 is a UV and E beam curable polyurethane water based dispersion. Siltech J-1015-O is a silicone surfactant. Sample "B" coating was 100 dry parts of Ucecoat 7578 and 10 dry parts of Siltech J-1015-O. Ucecoat 7578 is a UV or E beam curable polyurethane water based dispersion. The release coated handsheet samples were then taped to a web being printed and cured in the same manner as Sample 3 above. Thus, they ended up with a fully cured release coating and a patterened, fully cured, release coating on top of the first release coating.

The handsheet samples "A" and "B" with the patterned release coating were tested for release of Rhoplex B 20, Sancure 2710, Permax 320, Permax 202, Vycar 578 and Witcobond W 296 water based emulsions, as done above for the other samples. After the heat pressing, Sample "A" released from the Rhoplex B 20, the Vycar 578 and the W 296 coatings but not from the others. The "B" sample released well after heat pressing from all the coatings. The "A" and "B" samples with the patterned release coatings both released well from PETG panels after pressing for ten minutes in a heat press at 275 degrees F.; the PETG panels were embossed, as desired.

Example 2

Printed, Patterned Coating with a Release Coating

On the pilot line at PCT, a small roll of 100 lb, Sterling Ultragloss Web Text paper was printed (with the Paraprint printing plate described above) at 150 feet per minute using a 10 bcm anilox roll and coating "L" as above with light impression pressure. Curing was done in a Nitrogen atmosphere at 150 kilovolts and 4 megarads. The printed paper had a distinct pattern which could be stained only in the unprinted areas with a Sharpie marker. A 10% dry solids mixture of 100 dry parts Michem Prime 4983, 5 dry parts KAMA 7 and 10 dry parts Silwet J-1015-O was diluted to 6.7% dry solids with isopropanol, added for wetting. This mixture was applied using a #5 Meyer rod to the patterned paper, giving a coating weight of approximately 0.6 grams per square meter. The paper was then cured for 10 minutes at 80 degrees Centigrade. The paper released from a PETG panel after pressing it against the panel in a heat press for 5 minutes at 275 degrees Fahrenheit, giving an embossed PETG panel.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed:

1. A method of forming a casting paper, the method comprising:

coating a first surface of a base sheet with a release coating such that the release coating covers the entire first surface of the base sheet, wherein the release coating comprises a first curable polymeric material and a first release agent;

curing the release coating;

applying a printed release coating on a portion of the release coating, wherein the print coating comprises a second curable polymeric material and a second release agent; and curing the printed release coating to form the casting paper having a textured surface defined by elevated areas corresponding to the printed release coating and valley areas corresponding to exposed areas of the release coating wherein the release coating and the printed release coating are crosslinked upon curing so as to not melt at a transfer temperature of about 200° F. to about 400° F.

2. The method as in claim 1, wherein the printed release coating is flexographically printed onto the release coating.

3. The method as in claim 1, wherein the printed release coating is offset printed onto the release coating.

4. The method as in claim 1, wherein the printed release coating is rotary screen printed onto the release coating.

5. The method as in claim 1, wherein curing the release coating comprises exposing the release coating to e-beam radiation.

6. The method as in claim 1, wherein curing the printed release coating comprises exposing the printed release coating to e-beam radiation.

7. The method as in claim 1, wherein the first curable polymeric material and/or the second curable polymeric material comprises a curable monomer, a curable polymer, and a cross-linking agent.

8. The method as in claim 7, wherein the curable monomer comprises trimethylolpropane triacrylate.

9. The method as in claim 7, wherein the curable polymer comprises an acrylic polymer.

10. The method as in claim 7, wherein the crosslinking agent comprises an aziridine cross-linker.

11. The method as in claim 1, wherein the first curable polymeric material and the second curable polymeric material have substantially the same composition.

12. The method as in claim 1, wherein the first release agent and/or the second release agent comprises lauryl acrylate.

13. The method as in claim 1, wherein the first release agent and the second release agent have substantially the same composition.

14. The method as in claim 1, wherein the print coating is applied to a thickness of about 10 μm to about 1 mm.

15. The method as in claim 14, wherein the textured pattern corresponds to the negative image of the pattern to be cast onto a substrate.

16. The method as in claim 1, further comprising:

coating a thermoplastic layer onto the textured surface of the casting paper;

positioning the thermoplastic layer adjacent to a substrate;

heat transferring the thermoplastic layer to the substrate; and removing the casting paper from the substrate, such that the thermoplastic layer is transferred to the substrate while the release coating and the printed release coating remains on the base sheet of the casting paper.

17. The method as in claim 16, wherein heat transferring the thermoplastic layer to the substrate comprises applying heat at a transfer temperature of about 125° C. to about 200° C. to the base sheet of the casting paper.

18. The method as in claim 1, further comprising:

heating a thermoplastic surface on a substrate;

pressing the texturized surface of the casting paper onto the thermoplastic surface; and removing the casting paper from the thermoplastic surface such that the release coating and the printed release coating remains on the base sheet of the casting paper.

* * * * *